US005147148A

United States Patent [19]

White et al.

[11] Patent Number: 5,147,148

[45] Date of Patent: Sep. 15, 1992

[54] HEAVE-RESTRAINED PLATFORM AND DRILLING SYSTEM

[75] Inventors: Charles N. White; Riley G. Goldsmith, both of Houston, Tex.

[73] Assignee: Conoco Inc., Ponca City, Okla.

[21] Appl. No.: 695,484

[22] Filed: May 2, 1991

[51] Int. Cl.[5] ..... E02D 5/62; E02D 5/34

[52] U.S. Cl. ..... 405/199; 405/200; 405/223.1; 405/224.2

[58] Field of Search ..... 405/195, 199, 200, 224, 405/DIG. 8, DIG. 11, 195.1, 223.1, 224.2; 166/355, 335, 339, 341, 345, 350

[56] References Cited

U.S. PATENT DOCUMENTS

| | | | |
|---|---|---|---|
| 3,472,032 | 10/1969 | Howard . | |
| 3,602,302 | 8/1971 | Knuth . | |
| 3,612,177 | 10/1971 | Gassett et al. . | |
| 3,858,401 | 1/1975 | Watkins . | |
| 3,999,617 | 12/1976 | Ilfrey et al. . | |
| 4,363,567 | 12/1982 | Van der Graaf . | |
| 4,423,983 | 1/1984 | Dadiras et al. . | |
| 4,470,721 | 10/1984 | Shotbolt et al. . | |
| 4,470,722 | 10/1984 | Gregory . | |
| 4,511,287 | 4/1985 | Horton . | |
| 4,784,529 | 11/1988 | Hunter | 405/227 |
| 4,793,738 | 12/1988 | White et al. . | |
| 4,808,035 | 2/1989 | Stanton et al. | 166/355 X |
| 4,886,397 | 12/1989 | Cherbonnier | 405/195 |
| 4,934,870 | 6/1990 | Petty et al. | 405/195 X |
| 4,938,630 | 7/1990 | Karsan et al. | 405/195 X |
| 4,983,073 | 1/1991 | Petty et al. | 405/224 |

OTHER PUBLICATIONS

Ocean Industry, Sep. 1990, pp. 147 through 152, entitled "Minifloater: A Deepwater Production Alternative", By W. P. J. M. Kerckhoff.

*Primary Examiner*—Randolph A. Reese
*Assistant Examiner*—J. Russell McBee
*Attorney, Agent, or Firm*—A. Joe Reinert

[57] ABSTRACT

A Heave-Restrained Platform and Drilling System (HRP/DS) comprises a floating structure having a central buoyancy means, at least three out-rigger columns, and a hybrid mooring system in which a spread (lateral) mooring system functions with an array of tensioned production risers (serving as a vertical tension leg) to keep the structure generally over a specified seabed location. The HRP/DS provides a means for drilling and producing through oil wells in deep water such that critical pressure containment means are achieved with safe, redundant barriers and systems similar to those employed on shallow water fixed platforms.

21 Claims, 12 Drawing Sheets

HEAVE-RESTRAINED PLATFORM AND DRILLING SYSTEM

TECHNICAL FIELD

This application relates to U.S. Ser. No. 07/695,049 filed May 2, 1991; U.S. Ser. No. 07/694,587 filed May 2, 1991 and U.S. Ser. No. 07/695,231 filed May 2, 1991.

This invention relates to the art of floating offshore structures and drilling; and more particularly, to a moored, floating platform and well system for deep water offshore hydrocarbon production.

BACKGROUND OF THE INVENTION

With the gradual depletion of hydrocarbon reserves found offshore, there has been considerable attention attracted to the drilling and production of oil and gas wells located in water. In relatively shallow water, wells may be drilled in the ocean floor from bottom founded, fixed platforms. Because of the large size of the structure required to support drilling and production facilities in deeper and deeper water, bottom founded structures are limited to water depths of less than about 1,000–1,200 feet. In deeper water, floating drilling and production systems have been used in order to reduce the size, weight, and cost of deep water drilling in production structures. Ship-shape drill ships and semi-submersible buoyant platforms are commonly used for such floating facilities.

When a floating facility is chosen for deep water use, motions of the vessel must be considered and, if possible, constrained or compensated for in order to provide a stable structure from which to carry on drilling and production operations. Rotational vessel motions of pitch, roll and yaw involve various rotational movements of the vessel around a particular vessel axis passing through the center of gravity. Thus, yaw motions result from a rotation of the vessel around a vertically oriented axis passing through the center of gravity. In a similar manner, for ship-shape vessels, roll results from rotation of the vessel around the longitudinal (fore and aft) axis passing through the center of gravity causing a side to side roll of the vessel and pitch results from rotation of the vessel around a lateral (side to side) axis passing through the center of gravity causing the bow and stern to move alternatively up and down. With a symmetrical or substantially symmetrical platform such as a common semi-submersible, the horizontally oriented pitch and roll axes are essentially arbitrary and, for the purposes of this disclosure, such rotations about horizontal axes will be referred to as pitch/roll motions.

All of the above vessel motions are considered only relative to the center of gravity of the vessel itself. In addition, translational platform motions must be considered which result in displacement of the entire vessel relative to a fixed point, such as a subsea wellhead. These motions are heave, surge and sway. Heave motions involve vertical translation of the vessel up and down relative to the floatably fixed point along a vertically oriented axis passing through the center of gravity. For ship-shape vessels, surge motions involve horizontal translation of the vessel along a fore and aft oriented axis passing through the center of gravity. In a similar manner, sway motions involve the lateral, horizontal translation of the vessel along a left to right axis passing through the center of gravity. As with the horizontal rotational platform motions discussed above, the horizontal translational motions, surge and sway, in a symmetrical or substantially symmetrical vessel such as semi-submersible are essentially arbitrary and, in the context of this specification, all horizontal translational vessel motions will be referred to as surge/sway motions.

Combinations of the above-described motions encompass platform behavior as a rigid body in six degrees of freedom. The six components of motion result as responses to continually varying harmonic wave forces. These wave forces are first said to vary at the dominant frequencies of the wave train. Vessel responses in the six modes of freedom at frequencies corresponding to the primary periods characterizing the wave trains are termed "first order" motions. In addition, a variable wave train generates forces on the vessel at frequencies resulting from sums and differences of the primary wave frequencies. These are secondary forces and corresponding vessel responses are called "second order" motions.

A completely rigid structure fixed to the sea floor is completely restrained against response to the wave forces. An elastic structure, that is elastically attached to the sea floor, will exhibit degrees of response that very according to the stiffness of the structure itself, and according to the stiffness of its attachment to the earth at the sea floor. A "compliant" offshore structure is usually referred to as a structure that has low stiffness relative to one or more of the response modes that can be excited by first or second order wave forces.

Floating production or drilling vessels have essentially unrestricted response to first order wave forces. However, to maintain a relatively steady proximity to a point on the sea floor, they are compliantly restrained against large horizontal excursions by a passive spread catenary anchor mooring system or by an active controlled-thruster dynamic positioning system. These positioning systems can also be used to prevent large, low frequency (i.e. second order) yawing responses.

While both ship-shaped vessels and conventional semi-submersibles are allowed to freely respond to first order wave forces, they do exhibit very different response characteristics. The semi-submersible designer is able to achieve considerably reduced motion response by: (1) properly distributing buoyant hull volume between columns and deeply submerged pontoon structures, (2) optimally arranging and separating surface-piercing stability columns and (3) properly distributing platform mass. Proven principles for these design tasks allow the designer to achieve a high degree of wave force cancellation such that motions can be effectively reduced over selected frequency ranges.

The design practices for optimizing semi-submersible dynamic performance depend primarily on "detuning" and wave force cancellation to limit heave. Pitch/roll responses are kept to acceptable levels by providing large separation distances between the corner stability columns while maintaining relatively long natural periods for the pitch/roll modes. This practice keeps the pitch/roll modal frequencies well away from the frequencies of first order wave excitation and is, thus, referred to as "detuning". Wave force cancellation is achieved by properly distributing submerged volumes comprising the hull relative to the elements that penetrate water surface.

Another class of compliant floating structure is moored by a vertical tension leg mooring system. The tension leg mooring also provides compliant restraint of the second order horizontal motions. In addition, such a structure stiffly restrains vertical first and second order responses, heave and pitch/roll. This form of mooring restraint would be essentially impossible to apply to a conventional ship-shape monohull due to the wave force distribution and resultant response characteristics. Therefore, this vertical tension leg mooring system is generally conceived to apply to semi-submersible hull forms which can mitigate total resultant wave forces and responses to levels that can be effectively and safely constrained by stiffly elastic tension legs.

This type of floating facility, which has gained considerable attention recently, is the so-called tension leg platform (TLP). The vertical tension legs are located at or within the corner columns of the semi-submersible platform structure. The tension legs are maintained in tension at all times by insuring that the buoyancy of the TLP exceeds its operating weight under all environmental conditions. When the buoyant force of the water displaced by the platform/structure at a given draft exceeds the weight of the platform/structure (and all its internal contents), there is a resultant "excess buoyant force" that is carried as the vertical component of tensions in the mooring elements (and risers). When stiffly elastic continuous tension leg elements called tendons are attached between a rigid sea floor foundation and the corners of the floating hull, they effectively restrain vertical motions due to both heave and pitch/roll inducing forces while there is compliant restraint of movements in the horizontal plane (surge/sway and yaw). Thus, a tension leg platform provides a very stable floating offshore structure for supporting equipment and carrying out functions related to oil production. Conoco's Hutton platform in the North Sea is the first commercial example of a TLP. Saga's Snorre platform, being constructed for the North Sea, is a later example of a TLP.

The primary interest in the TLP concept is that the stiff restraint of vertical motions makes it possible to tie-back wells drilled into the sea floor to production facilities on the surface through a collection of pressure containment apparatuses (e.g., the valves of a well "tree") such that the "tree" is located above the body of water within the dry confines of the platform's well bay. This "dry tree" concept is very attractive for oil field development because it allows direct access to the wells for maintenance and workover. As water depth (and, thus tendon length) increases, tendons of a given material and cross-section become less stiff and less effective for restraining vertical motions. To maintain acceptable stiffness, the cross-sectional area must be increased in proportion to increasing water depth. For installations in deeper and deeper water, a tension leg platform must become larger and more complex in order to support a plurality of extremely long and increasingly heavy tension legs and/or the tension legs themselves must incorporate some type of buoyancy to reduce their weight relative to the floating structure. Such considerations add significantly to the cost of a deep water TLP installation. Conoco's Jolliet TLWP (Tension Leg Well Platform) in the Gulf of Mexico addresses this problem by citing production equipment on a nearby conventional platform in shallower water. However, this approach is limited to locations that have sites relatively nearby for the production equipment.

In addition, in deeper and deeper water, a greater percentage of the hull displacement must be dedicated to excess buoyancy (i.e. tendon pretension) to restrict horizontal offset. Station-keeping is a key role for the mooring system. The vertical tension leg mooring system provides the capacity to hold position above a fixed point on the sea floor as any horizontal offset of the platform creates a horizontal restoring force component in the angular deflection of the tendon tension vector. In deeper and deeper water, it requires greater tendon pretension to provide enough restoring force to keep the TLP within acceptable offset limits. This increases leads to larger and larger minimum hull displacements. As in aircraft and motor vehicle design, there is a multiplying effect. That is, each unit of additional weight requires additional structural weight to support it which in turn requires still more weight or mass of the structure. Thus, any decrease in weight or mass of essential elements leads to considerable savings.

This art was further advanced, in respect to limiting the impact of increasing water depth on the size, cost, and complexity of the mooring system and platform, with the disclosure of a single leg tension platform (STLP) in U.S. Pat. No. 4,793,738. In accordance with that invention, a single leg tension platform (STLP) was disclosed to comprise a large central buoyant column surrounded by a number of peripheral stability columns. In a preferred embodiment, peripheral stability columns were disclosed to be symmetrically spaced about the central column. The central column and the peripheral stability columns were disclosed to be connected together as one structure, the connection in one embodiment taking the form of an arrangement of subsea pontoons which rigidly connect the various columns near their lower ends and/or key structural bracing penetrating the water surface. The columns, especially the central column, support a deck from which drilling and other operations can be conducted.

Further in accordance with that invention, the STLP has a mooring system which incorporates both a vertical single tension leg system and a lateral (e.g., spread catenary) mooring system. The vertical tension leg is arranged so that it effectively restrains only the heave component of the vertical motions. The vertical tension leg mooring system and the spread mooring are disclosed to act in concert to compliantly restrain low frequency horizontal motions, surge/sway and yaw. The use of a hybrid mooring system as described for that invention reduces the impact of increasing water depth on minimum hull displacement and tendon pretension and thus reduces weight and cost.

There continues to be a compelling need for improved platforms and drilling systems, particularly those which are less costly and safer, for production of hydrocarbons from beneath relatively deep water, particularly water depths of 500 feet to 8000 feet, and more particularly 1000 to 4000 feet. Unless this need is satisfied, only very rich reservoirs will support development at such relatively great depths. Therefore, it is appropriate to examine all aspects of deep water drilling and production systems in order to identify those features which are most sensitive to increasing water depths. In this regard, it is necessary to give careful consideration to both drilling and well systems, and tie-back riser design.

As water depth increases, the risers become naturally longer just as the tendons do, as discussed above. To achieve proper top end support so as to limit riser responses in severe metocean conditions, riser top tensions must be increased at a greater rate than the rate by which water depth is increased. Therefore, risers and riser tensions tend to place an ever increasing load on the floating (TLP) structures as they are placed in deeper waters.

Further as offshore development moves to deeper waters, the drilling environment can change in a manner such that any wells being drilled through the various subterranean formations will encounter "over-pressured" zones where fluids are charged with a formation pressure which exceeds the pressure head that can be supplied by a correspondingly deep (or high) column of water. These well "over-pressures" are normally contained/controlled by a multiplicity of pressure containment means. It is considered standard practice that at least two of these pressure containment means be independent of each other. In deep water, situations can occur where the pressure containment provided by a special well control fluid (a mixture denser than water that is usually called "mud") and the pressure containment provided by a tie-back casing/riser+surface "tree" are not independent. In these situations (which are commonplace for deep water wells in the Gulf of Mexico for example), a leak in the casing/riser near the seabed could result in loss of so much well control fluid from riser that the formation pressure down-hole would not be contained. The result would be a "blow-out". In order to ensure that a leak in the primary casing does not result in complete loss of well control, it has been practiced that a second casing string has been employed surrounding the primary pressure containing casing (e.g., a concentric casing riser design to be employed on the Shell "Auger" platform). Such a measure is a reasonable practice, but it does result in a much heavier riser string to be supported by top tension at the floating platform. The increased riser tensions lead to much larger platform dimensions and cost.

SUMMARY OF THE INVENTION

The present invention provides a deep water drilling and production facility of relatively low complexity which combines the advantages of a laterally (catenary) moored semi-submersible with some of the advantages of a tension leg platform at a greatly reduced cost and with improved safety. More particularly, the platform and drilling system can have protected risers, does not require foundation templates, has a fully functional spread mooring, can have a fixed central derrick such that derrick loads are applied to the platform center, and can have a considerably simplified installation and operating procedures. Thus, this invention can be looked upon as the fourth generation of TLP ancestry, i.e., TLP-TLWP-STLP-HRP/DS. It addresses the need for improved platforms and drilling systems for relatively deep water.

In accordance with the invention, a heave-restrained platform comprises:

(a) a floating structure having a central buoyancy means and at least three out-rigger columns connected in substantially rigid relationship to one another, the central buoyancy means having support for upper terminations of a plurality of production risers, (b) the risers being connected to hydrocarbon wells on the floor of a body of water upon which the floating structure floats within a horizontal locus generally beneath the floating structure and being connected to the floating structure under sufficient tension such as to also function as tendons to restrain heave of the floating structure in addition to functioning as conduits for hydrocarbon production, (c) each riser being comprised of plural concentric tubular structural and pressure containment elements connecting a hydrocarbon well on the floor of the body of water with a pressure containment means located on the floating structure, and (d) at least three lateral anchor lines attached to the floating structure and to the floor of the body of water at loci lateral of the locus of attachment of the risers and under sufficient tension and in an array such as to maintain the floating structure substantially on horizontal location.

In accordance with one presently preferred embodiment, the risers are connected to the floating structure via porches at a locus below the surface of the body of water and below the center of effective mass of the floating structure.

In accordance with one presently preferred mode, the lateral anchor lines are catenary anchor lines.

In accordance with another presently preferred mode, the lateral anchor lines are neutrally buoyant lines having elasticity.

In accordance with another presently preferred mode, the lateral anchor lines are spring buoy mooring lines.

In accordance with other presently preferred mode, production can either be through the center or through an annulus of the concentric tubular structural pressure containment elements of a riser. A bundle of a plurality of smaller diameter tubulars can also be located within a larger diameter tubular. Generally, for the sake of safety and environmental protection the hydrocarbons are isolated from the body of water by a plurality of casings (tubulars).

According to another presently preferred mode, a drilling derrick is cited more or less horizontally centered. For example, the drilling derrick can straddle the moonpool or be located in that general horizontal location, such as near the edge of the moonpool or on a skiddable or rotatable base such as to be moveable either wholly or partially around the moonpool or from side to side across the moonpool. If a base is employed for movement of the derrick, means must be provided for securing the derrick in place once movement is completed, for example, during periods of rough seas.

A heavy duty lifting crane can be similarly disposed beneath the derrick but overhead of the surface pressure containment means (well "trees"). The lifting crane can be supported on a rotatable rail structure such that it will have the capacity for translation across the rails. This configuration will give the lifting crane overhead access to all points of the wellbay. This crane can be equipped with motion compensating tensioning devices (usually hydraulic) such that it can support riser strings run through and hung onto its load supporting means. The rail structure of this heavy lifting system can support a translating "dolly" carriage which can be used to locate pressure containment means (such as a Blow-out Preventer valving arrangement) over and onto any drilling riser supported by the crane.

In accordance with another presently preferred mode, the buoyancy distribution and location of buoyancy is designed such as to minimize tension variations on the risers and to minimize pitch/roll, using principles known to those skilled in the art. Similar but differing effects occur on semisubmersible platforms and tension leg platforms. Material on motion optimization for STLP's has been published: White, Triantafyllou, Erb, "Response Cancellation As A Tool For Single Leg TLP Optimization", OMAE, 1988. Very similar effects occur with the HRP/DS of this invention. However, the radius of the top end attachment points of the riser/-tendons introduces limited pitch/roll restraining effect which is critical to the optimization of motions performance. Buoyancy distribution is normally adjusted by means of buoyant connecting pontoons between the columns or fabricating the columns in the shape of bottles, with footings, etc. The design for optimum wave transparency or minimization of pitch/roll and tension variations will be dependent upon the platform size and environmental parameters of the location of the platform, but is well within the level of the ordinary skill of those skilled in the art such as ocean engineers or naval architects once the invention at hand has been disclosed.

In accordance with yet other presently preferred modes, the floating structure is taken to the heave-restrained mode by riser running operations which are related to those employed on conventional floating platforms. The simplified methods of the invention are quite advantageous in this regard because experienced drilling crews can employ them without extensive and expensive training. Cost savings and greater safety and efficiency are the result. These simplified installation methods are more thoroughly described hereinafter.

In accordance with presently preferred modes, the central buoyancy means comprises one of three configurations. It can comprise a central column with a large moonpool enclosing supports for the upper terminations of the risers, or a plurality of central columns having the supports disposed inward, or a central column having the supports disposed in an outward array.

In accordance with yet another presently preferred mode, the drilling derrick is solidly affixed to the floating structure over the moonpool and the lateral anchor lines are adjusted to move the platform over each well in succession as drilling or workover operations are effected. It is thus possible to employ the ability of the lateral mooring system to horizontally position the platform and space out wells on the floor of the body of water such as to avoid the need for an expensive template.

BRIEF DESCRIPTION OF THE DRAWINGS

The objects of the invention will be apparent from the following description taken in conjunction with the drawings which form a part of this specification. A brief description of the drawings follows.

DETAILED DESCRIPTION OF THE INVENTION

Figure 1:
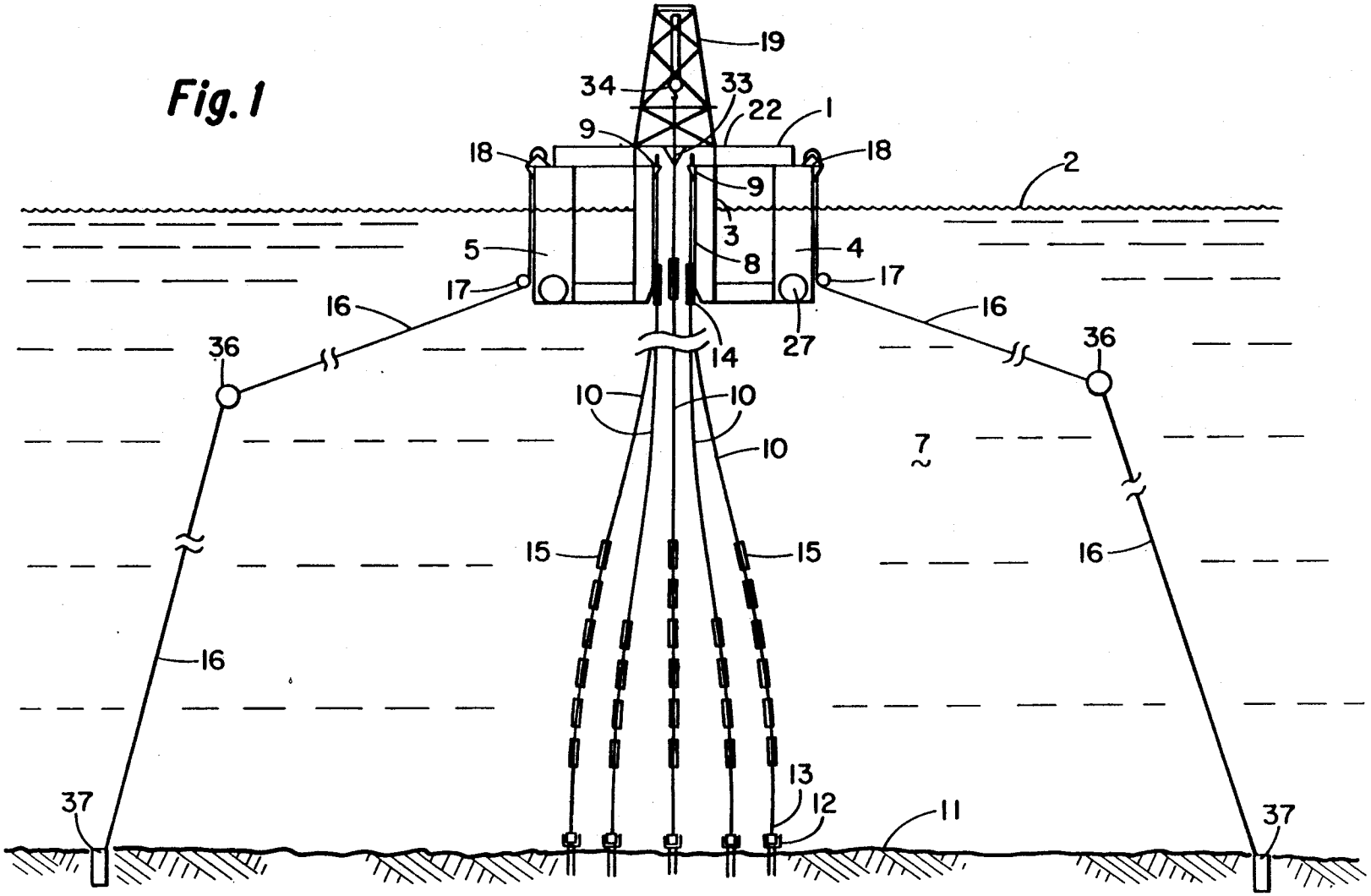
FIG. 1 is a simplified semi-schematic cross sectional side view of a four column configuration of the invention.
Figure 2:
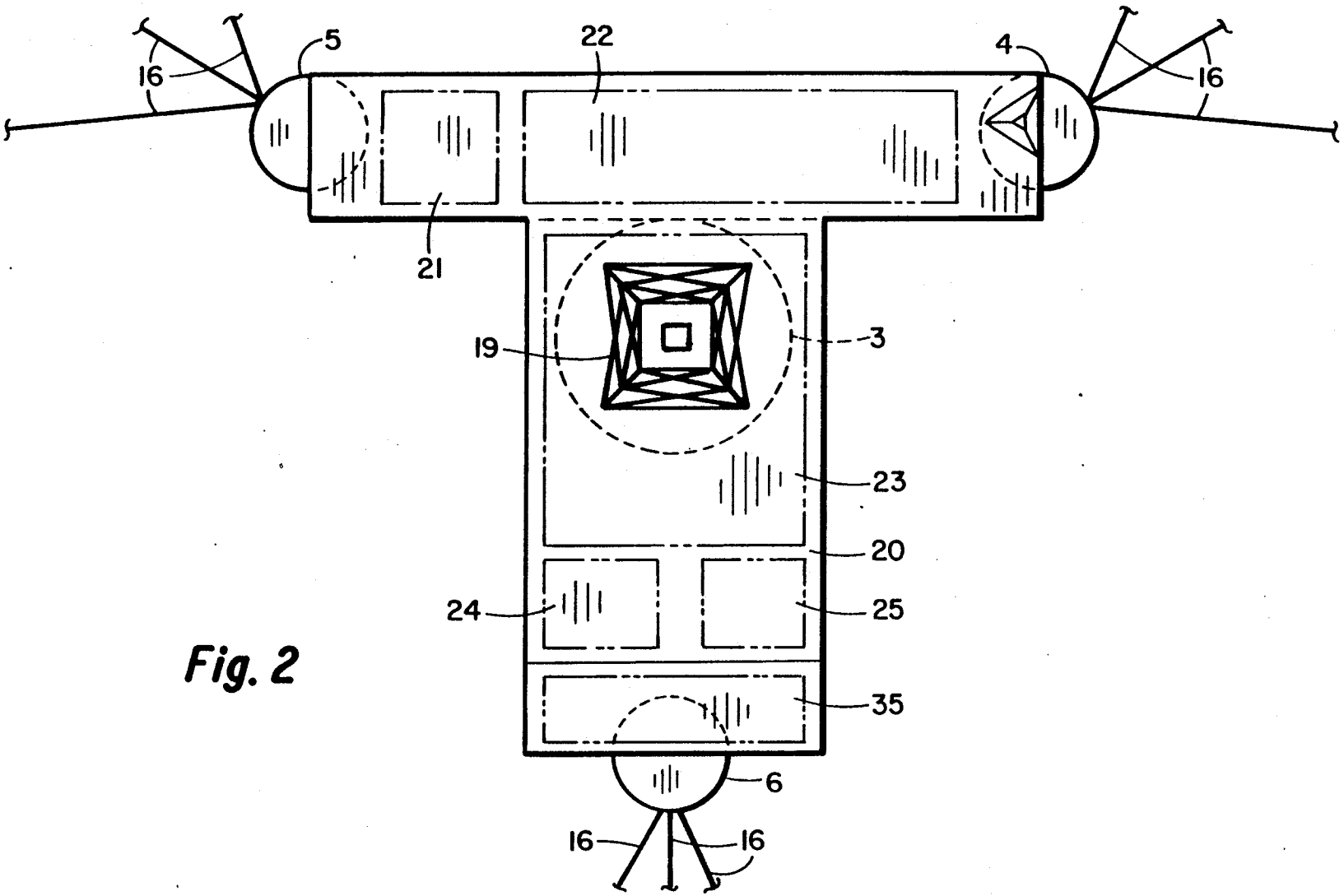
FIG. 2 is a top down view in semi-schematic and simplified format of the structure of FIG. 1.

FIGS. 1 and 2 show in simplified format a four column configuration of the heave-restrained platform and drilling system (HRP/DS) of the invention. Thus, a floating structure 1 having a central column 3 and three out-rigger columns 4, 5, and 6 floats on the surface 2 of the body of water 7. The central column 3 has a moonpool 8 which encloses the upper terminations 9 of risers 10. The risers 10 are connected to the floor 11 of the body of water 7 upon which the floating structure 1 floats at a locus generally horizontally directly below the floating structure 1 via connectors 13 to wellheads 12. In the mode shown, water depth is about 2,000 feet, which is foreshortened in FIG. 1 to better show detail. The wellheads 12 are in a circular pattern, of which only five are shown defining the horizontal locus generally below the floating structure. There is generally much less than one degree deviation from vertical at the point of attachment of the risers to the sea floor. The risers also have fenders 14 at the point of possible contact with the moonpool and optional external buoyancy units 15 as shown. Alternatively, the riser can be attached to the periphery of the moonpool on porches near the keel, and have a tubular element thereof extend upward to a tree deck. The risers are under sufficient tension to function as tendons to pull the floating structure 1 down into the water to a sufficient depth that heave is completely restrained as with a TLP. Lateral mooring lines 16 which can be neutrally buoyant and elastic or can have a catenary or spring buoy configuration and can be adjusted by means of pulley 17 and winches 18 to horizontally position or maintain station of the floating structure 1. A spring buoy configuration is shown with buoyancy means 36 tensioning lateral mooring lines 16 between the floating structure 1 and anchors 37. The floating structure 1 has a fixed central derrick 19 extending over the moonpool and mounted on deck 20. The deck 20 has a lay down area 21, a process area 22, a driller area 23, a utilities area 24, and a power area 25. The lateral moorings are attached to the sea floor at points (not shown) in an array that enables station keeping or ready horizontal positioning using marine deck equipment on the platform. The crew quarters area 35 can also be located as convenient.

Figure 3:
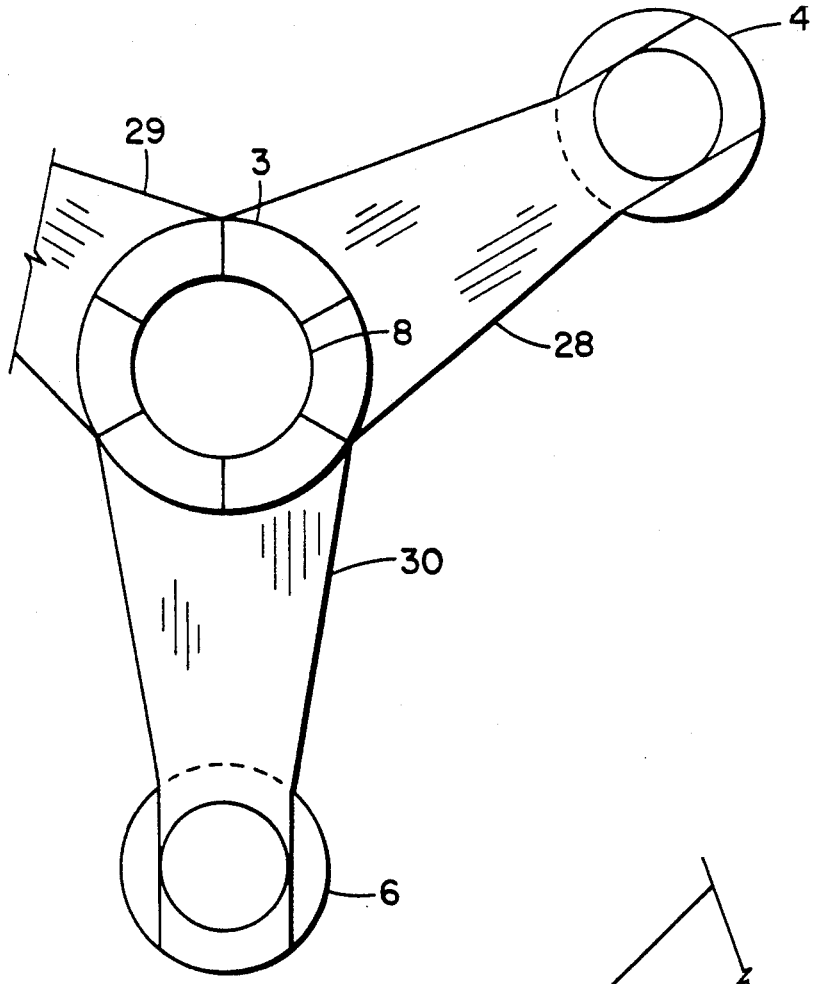
FIG. 3 is a partially cut away schematic view of the arrangement of the columns of FIG. 2.

FIG. 3 shows details of the pontoon level 27 of the HRP/DS. Thus, central column 3 having moonpool 8 is connected to columns 4, 5 (not shown) and 6 by means of pontoons 28, 29, and 30 at pontoon level 27.

Figure 4:
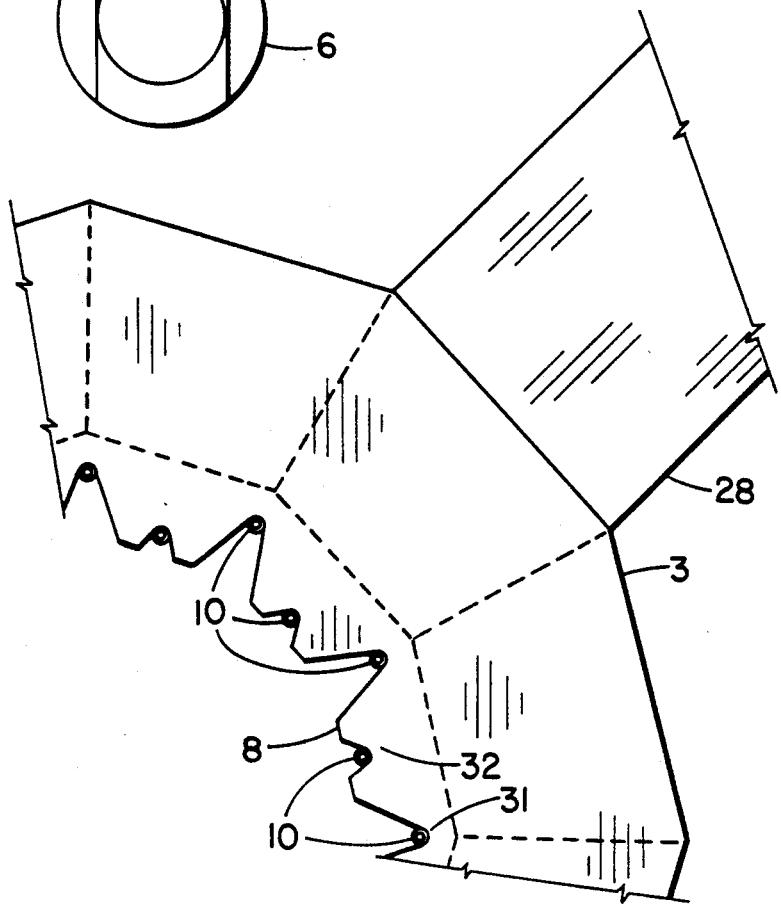
FIG. 4 is a top down schematic view of a 24 well mode taken at the pontoon level of the HRP/DS.

FIG. 4 is a cut away top down schematic at pontoon level 27 showing detail of the layout for wells in the moonpool with a mode having a 24 well configuration. Thus, moonpool 8 in column 3 connected to pontoon 28 has landing porches or supports 31 and 32 for risers 10. The risers are moved to the center for drilling or workover by a crane dolly which is supported on rails beneath the traveling block under derrick 19. The rails span the wellbay area allowing access to all points where lifting is required for trees and risers.

Figure 5:
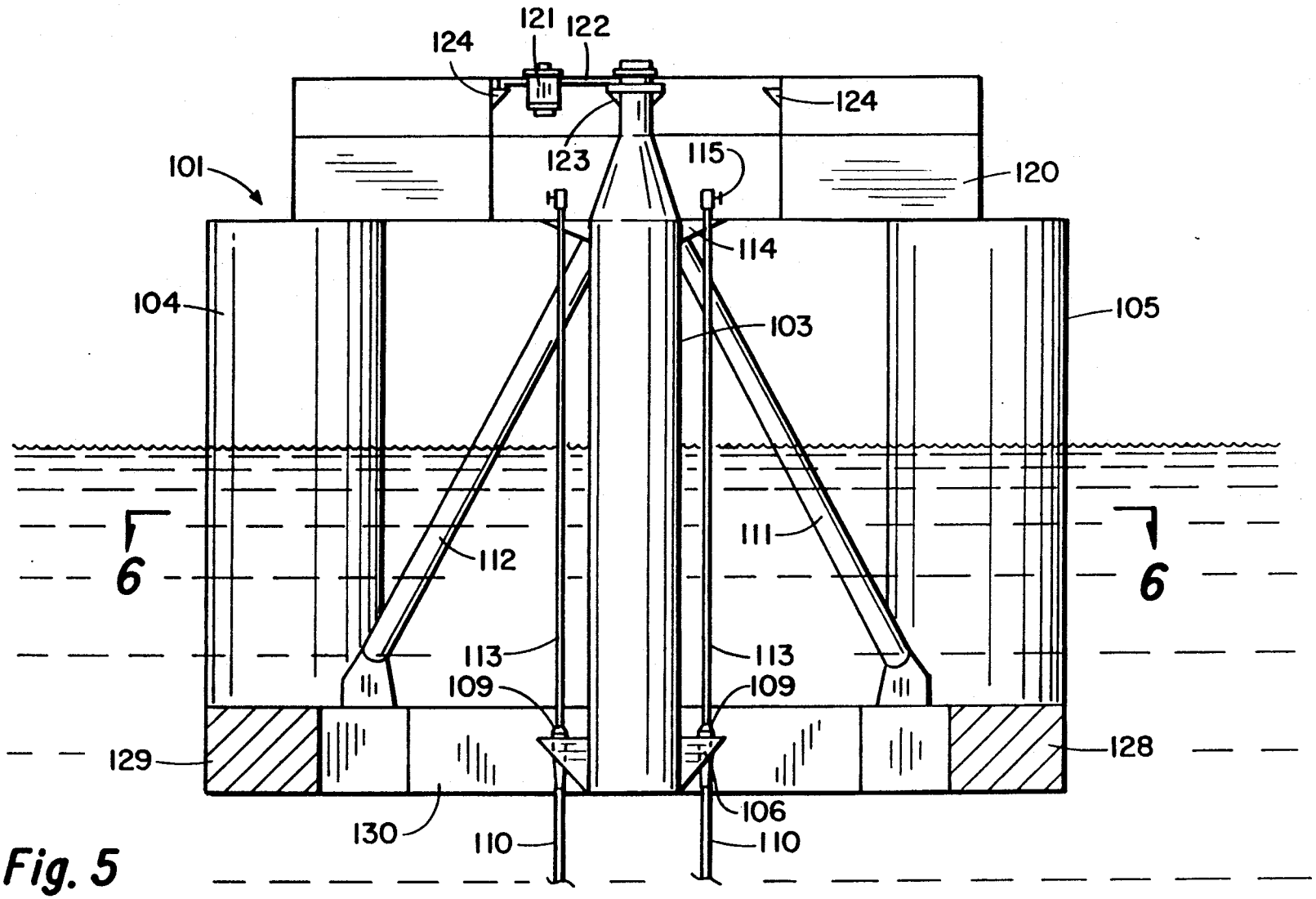
FIG. 5 is a simplified semi-schematic partial cross sectional side view of a mode of the invention in which the central buoyancy means comprises a central column having supports for the upper terminations of the risers disposed in outward array and having four outrigger columns.
Figure 6:
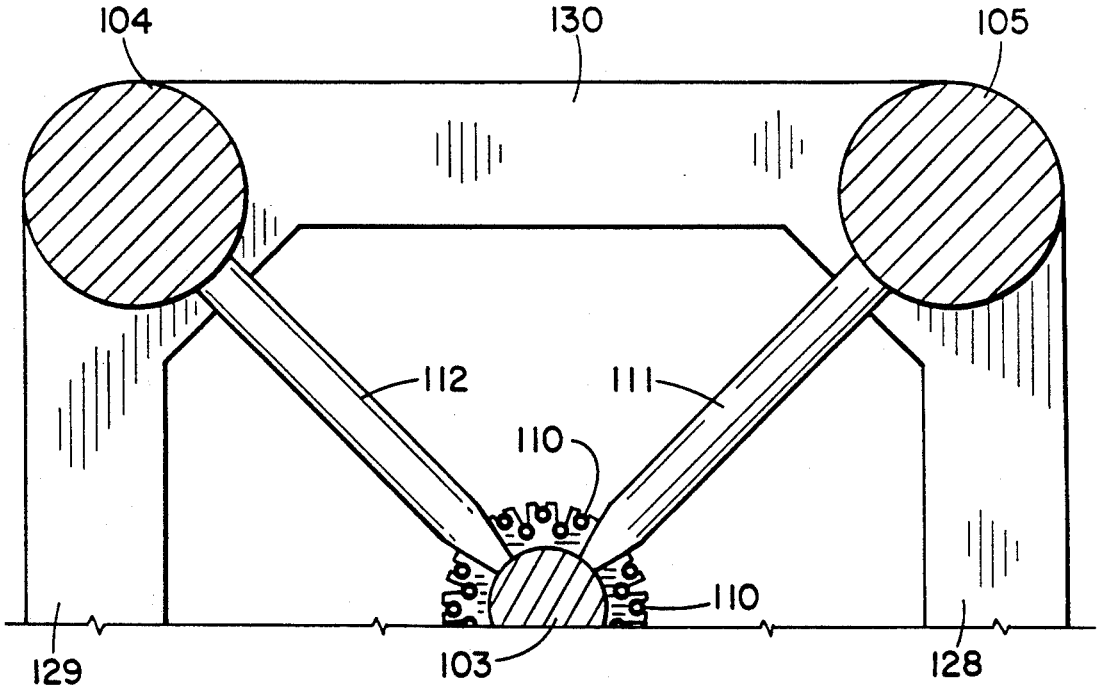
FIG. 6 is a top down partial semi schematic view of the structure of FIG. 5 taken at the pontoon level.

FIG. 5 is a simplified semi-schematic partial cross sectional side view of another mode of the invention, and FIG. 6 is a top down partial semi-schematic view of the structure of FIG. 5 taken at the pontoon level. In this mode, the central buoyancy means comprises a central column having supports for the upper terminations of the risers in outward array rather than inward array within the moonpool. This mode also has four outrigger columns rather than three and other features which are noted as follows.

Thus, referring to FIG. 5 and FIG. 6, floating structure 101 has a central column 103 and four outrigger columns, columns 104 and 105 of which are shown. The central column 103 has a porch 106 which functions as a support for risers 110 at their upper terminations 109 which are on or near the pontoon level at a locus below the surface of the body of water 107 and below the center of effective mass of the floating structure 101. Details which are similar to FIG. 1 such as wellheads, lateral mooring lines, winches, etc. are not shown for the sake of simplicity and clarity. The risers 110 function as tendons tensioned sufficiently by the floating structure's 101 excess buoyancy such that heave is stiffly restrained as with a TLP.

The floating structure 101 has a deck 120 rigidly connecting columns 103, 104, 105, etc., and pontoons 128, 129, and 130 rigidly connecting columns 104, 105, etc. as well as diagonal struts 111 and 112 providing further strength and rigidity to the floating structure 101.

The risers 110 have terminations 109 which are supported on porch 106 by terminations 109 which are concavoid and fit into a convexoid slotted receptacle. The inner tubulars 113 extend up to retainer 114 and terminate at pressure containment means 115.

A heavy duty lifting device 121 is mounted on spanning support 122 and porches 123 and 124 and is employed to tether down floating structure 101.

Figure 8:
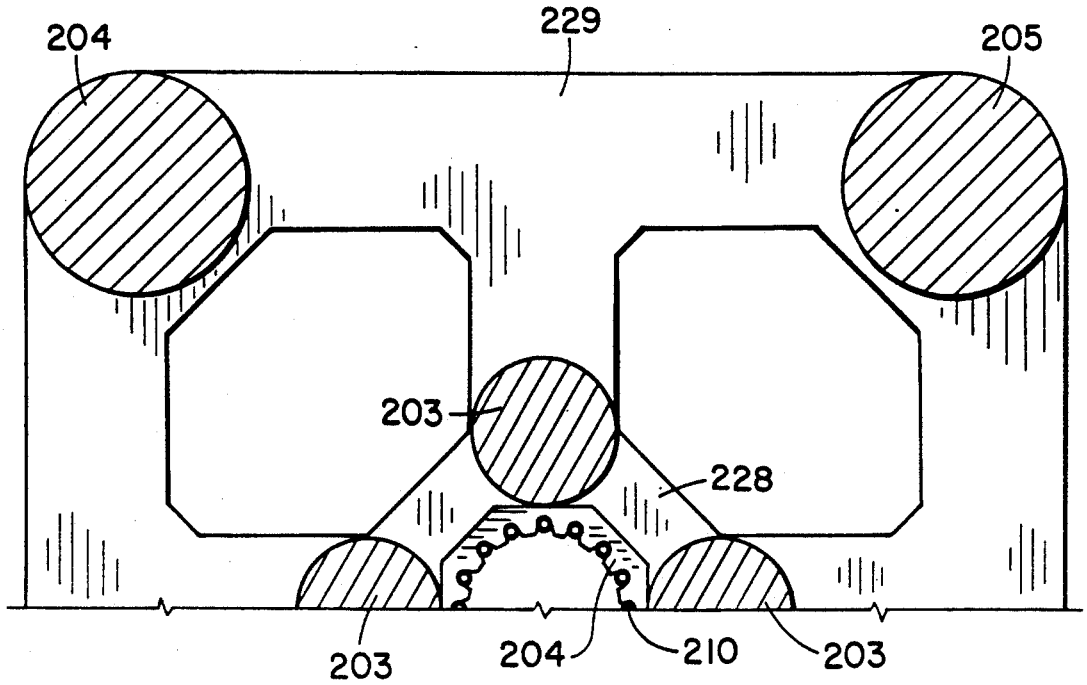
FIG. 8 is a top down partial semi-schematic view of the structure of FIG. 7 taken at the pontoon level.
Figure 7:
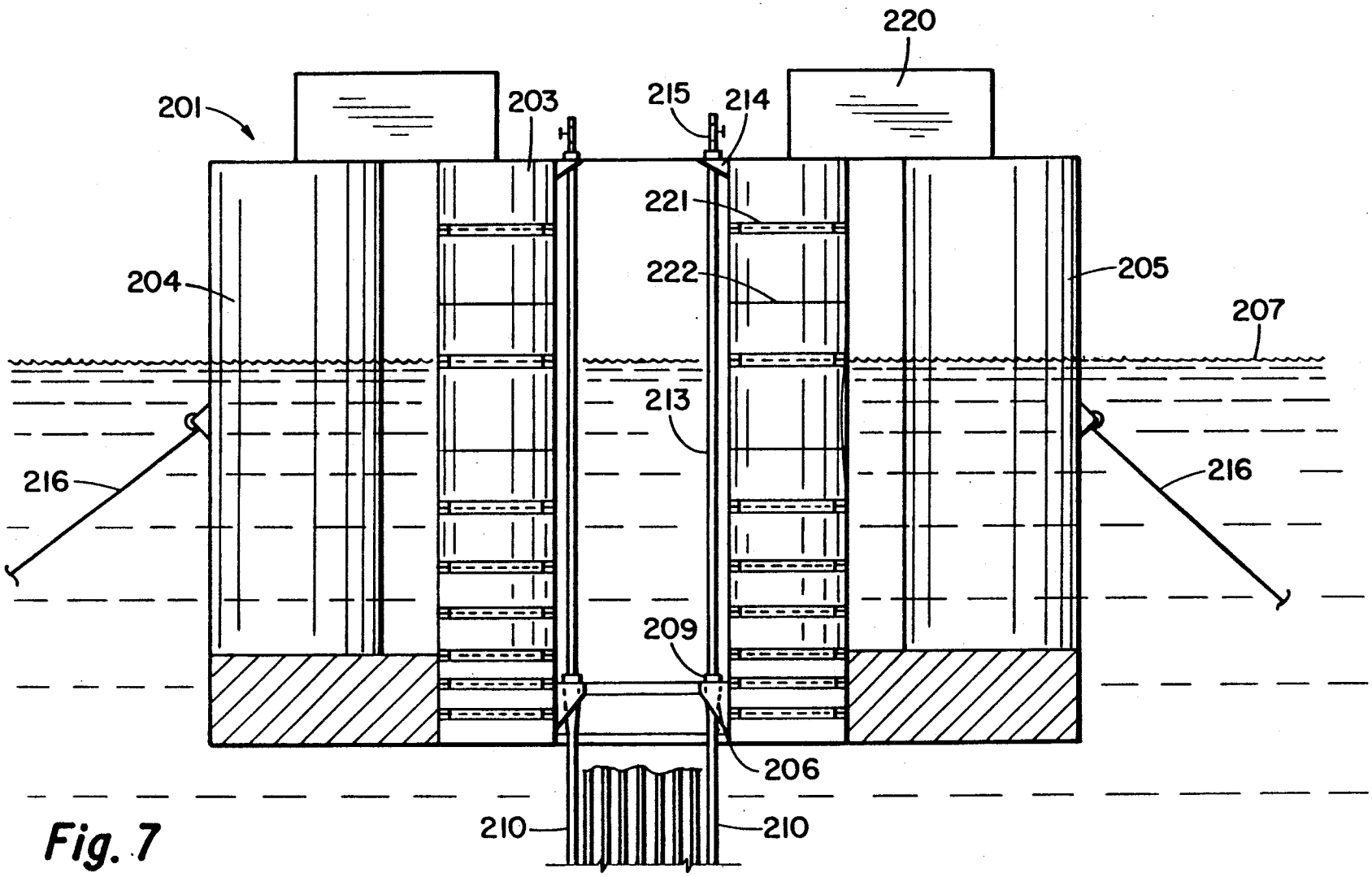
FIG. 7 is a simplified semi-schematic partial cross sectional side view of a mode of the invention in which the central buoyancy means comprises a plurality (4) of central columns having the supports disposed inward and having four outrigger columns.
Figure 9:
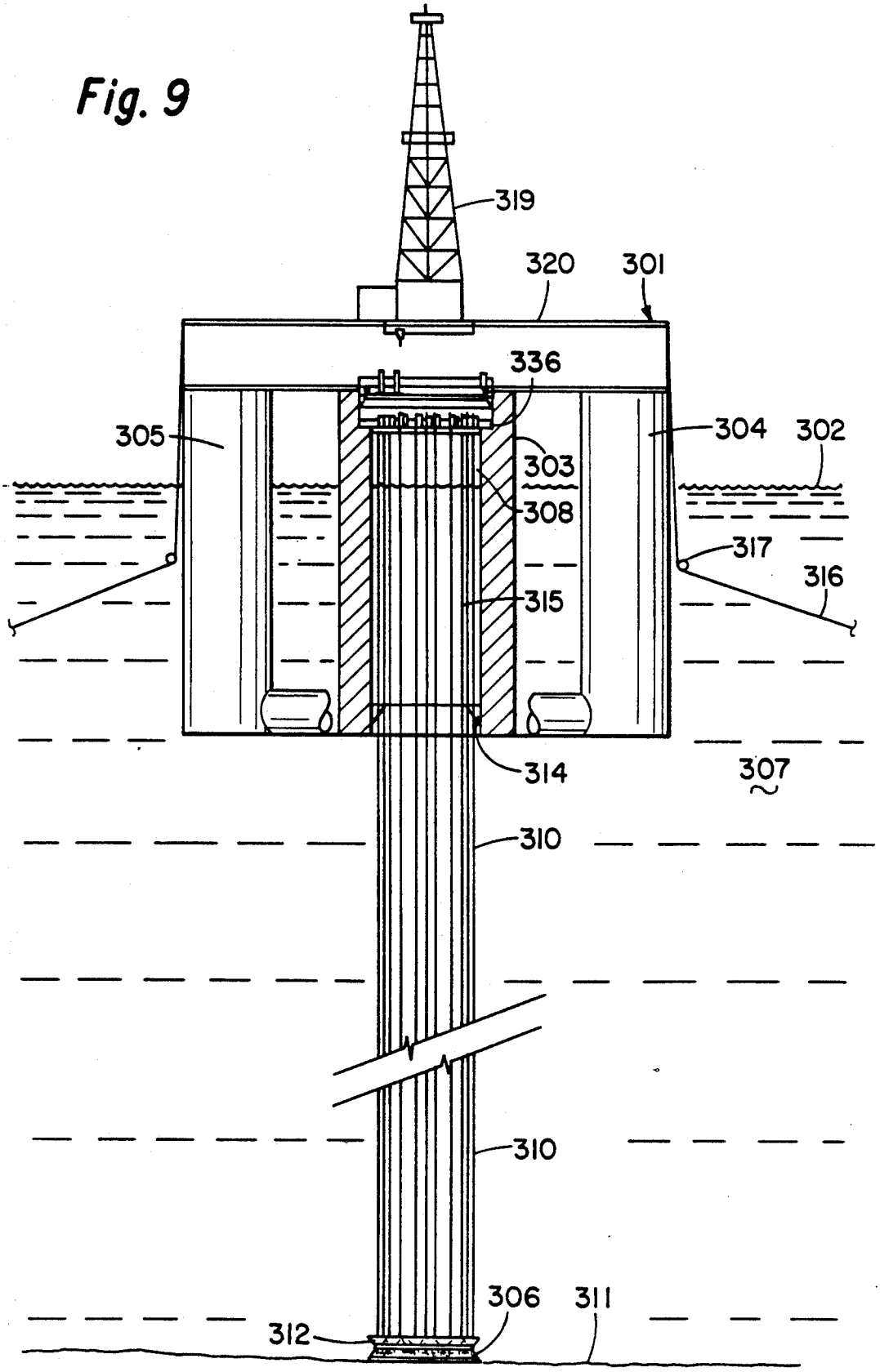
FIG. 9 is a simplified semi-schematic cross-sectional side view of another configuration of the invention having five columns.
Figure 10:
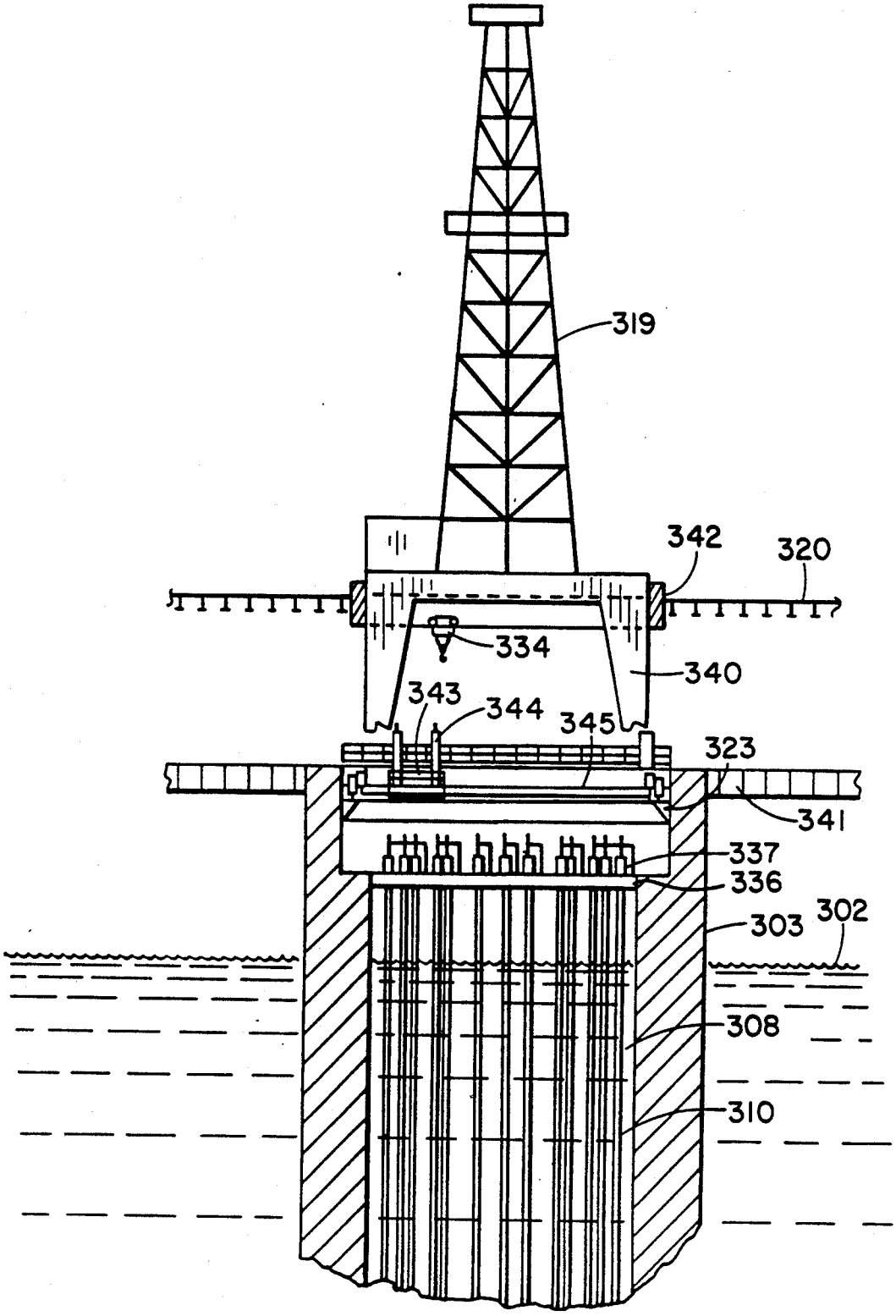
FIG. 10 is a blown-up portion of FIG. 9 showing more detail.
Figure 11:
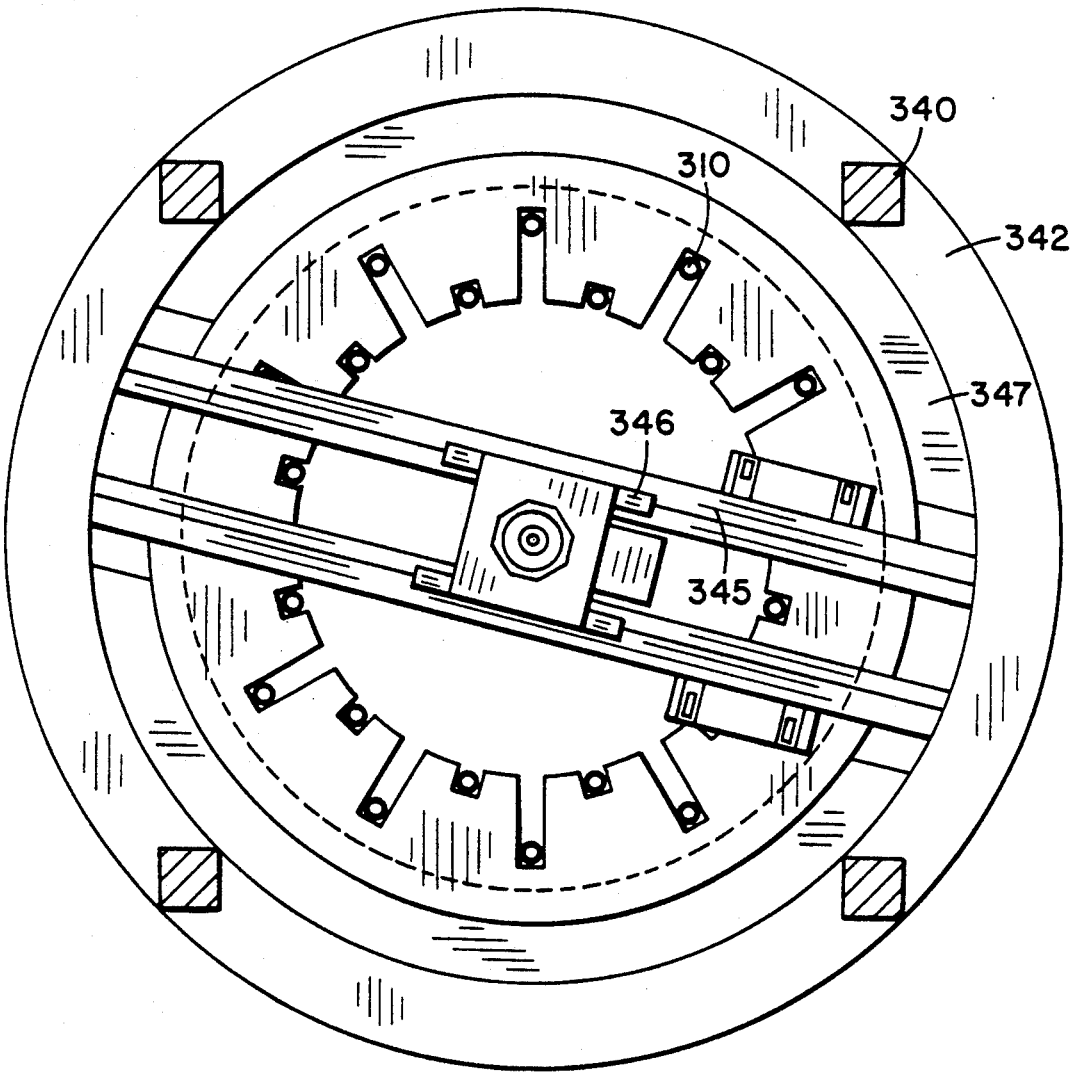
FIG. 11 is a top down partial semi-schematic view taken above the moonpool.
Figure 12:
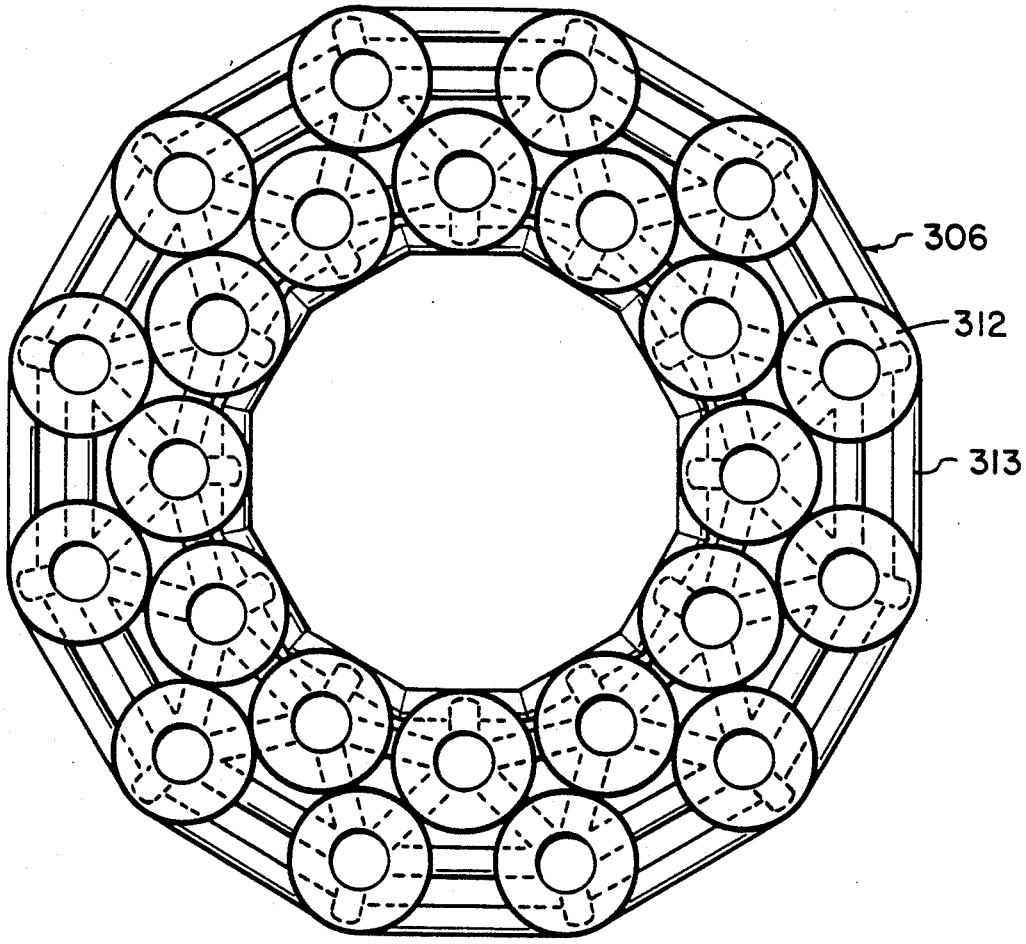
FIG. 12 is a top down semi-schematic view of a seabed template.
Figure 13:
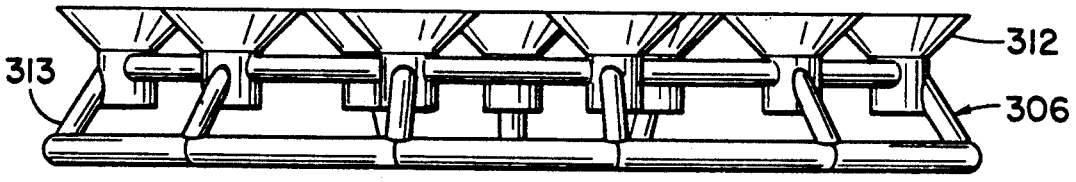
FIG. 13 is a side semi-schematic view of the template shown in FIG. 12.

FIG. 7 shows another mode of HRP/DS of the invention in simplified semi-schematic partial cross sectional side view, and FIG. 8 is a top down partial semi-schematic view of the structure of FIG. 7 taken at the pontoon level. In this mode, the central buoyancy means comprises four columns 203 landing on a supporting buoyant ring structure 228 which forms part of the base flotation pontoon structure 229. This ring also supports an inwardly facing porch 204 for support of the riser/tendons 210.

Floating structure 201 has four outrigger columns 204, 205, etc. and the central buoyancy means comprises four central columns 203 which have porches 206 affixed thereto. The columns 203 have stiffening rings 221 and bulk heads 222. The porch 206 has slotted convexoid receptacles for concavoid terminations 209 for riser 210. Inner tubulars 213 extend to pressure containment means 215 and are supported on porch 214. The floating structure 201 has deck structure 220 and is tethered down by riser-tendons 210 below the surface of the water 207 such that heave is suppressed. Lateral moorings 216 function in the same manner as described with reference to FIG. 1. Pontoon structure 229 and deck 220 function to give rigidity to the floating structure 201.

FIGS. 9, 10, 11, 12, and 13 disclose a presently preferred configuration of the invention having four outrigger columns. Thus, the floating structure 301 having a central column 303 and four outrigger columns of which outrigger columns 304 and 305 are shown floats along the surface 302 of body of water 307. The central column 303 has a moonpool 308 which encloses the upper terminations of risers 310. The risers 310 are connected to the floor 311 of the body of water 307 upon which the floating structure 301 floats at a locus generally horizontally directly below the floating structure 301 by way of a template 306 having funnel shape receptacles 312 disposed on tubular framework 313. The riser 310 are attached to the periphery of the moonpool on porches 314 near the keel and have tubular elements 315 extending upward to a tree deck 336 and have pressure containmemt means 337 disposed thereon. Lateral mooring lines 316 can be neutrally buoyant and elastic or can have a catenary or spring buoy configuration or can be neutrally buoyant and elastic. They can be adjusted by means of pulleys 317 and winches (not shown) to horizontally position or maintain station of the floating structure 301. The floating structure 301 has a derrick 319 mounted on supports 340 supported on deck 341 on support ring 342 disposed in an opening in deck 320. In addition to the derrick disposed over the moonpool having lifting means 334 disposed there below deck 341 also supports heavy duty lifting means 343 supported on cylinders 344 and slides 346 mounted on rails 345 which in turn are mounted on support ring 347 such that the lifting means 343 is able to reciprocate on rails 345 and rotate or reciprocate on support ring 347 so as to be positionable above any point in the moonpool and above each of the riser/tendons 310.

Figure 14:
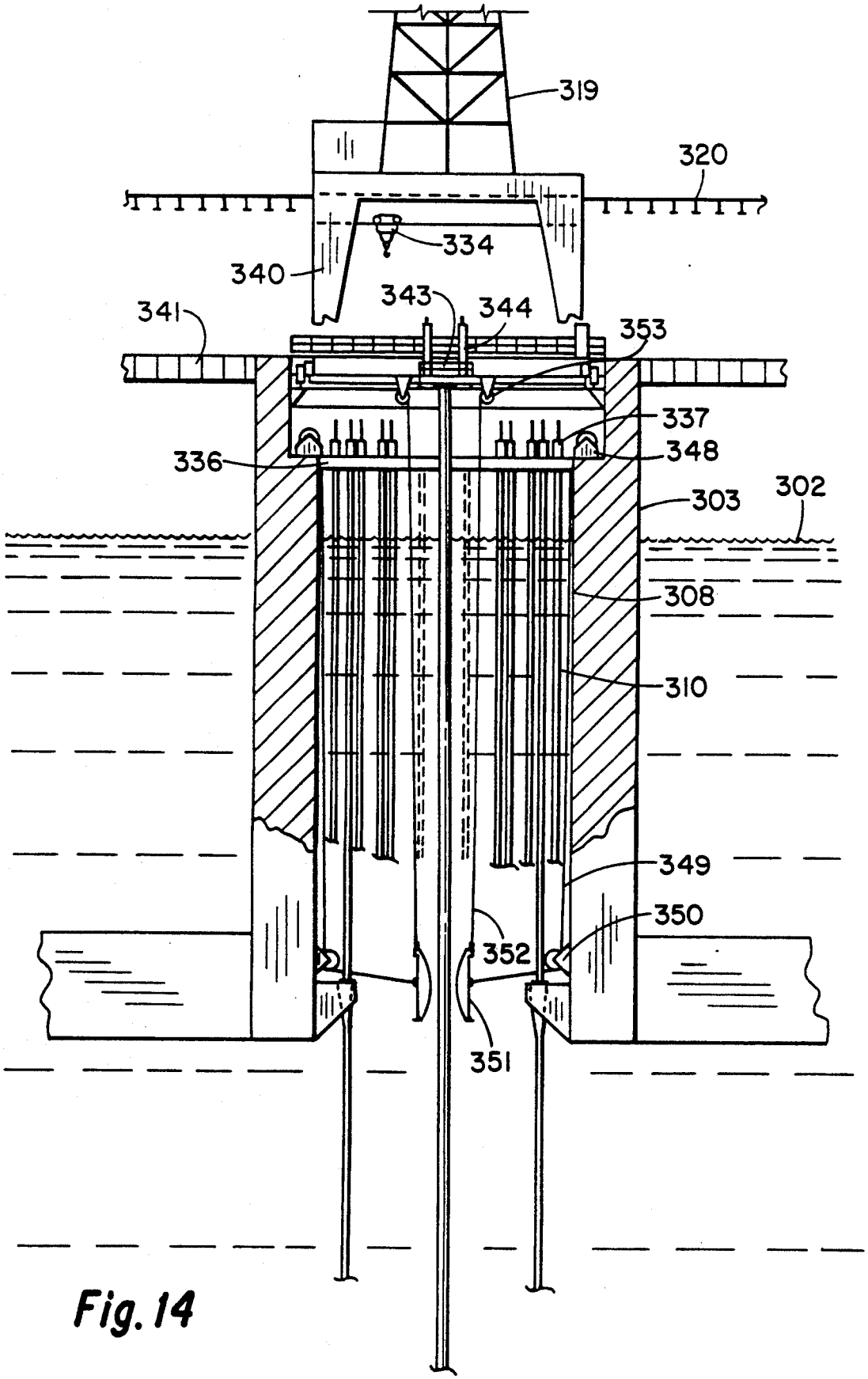
FIG. 14 is a partial side schematic view of the HRP/DS configuration of FIG. 9 showing detail of apparatus for emplacing the tendon/risers.

FIG. 14 shows one configuration of apparatus for adjusting the horizontal position of risers 310 in the configuration of the invention shown in FIGS. 9, 10, 11, 12 and 13.

Figure 15:
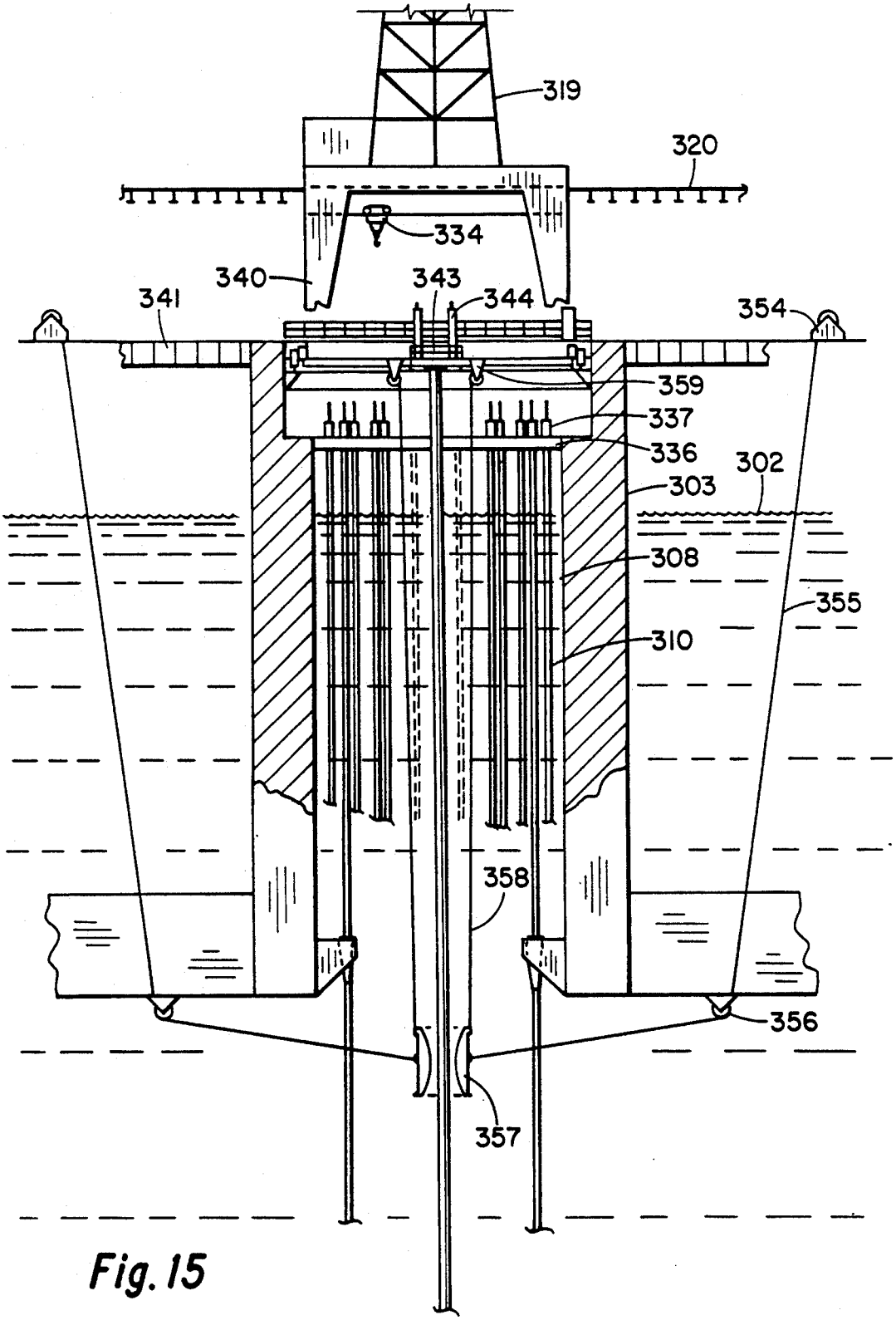
FIG. 15 is a partial semi-schematic side view of the HRP/DS configuration of FIG. 9 showing detail of another embodiment of apparatus for emplacing the tendon/risers.

FIG. 15 shows another configuration of apparatus for adjusting the horizontal position of risers 310 on the configuration of the invention shown in FIGS. 9, 10, 11, 12 and 13.

Common features shown and numbered in FIGS. 9 through 13 are numbered the same on FIGS. 14 and 15. Additionally, in FIG. 14, winch 348 connects via line 349 and pulley 350 to a half or third section of centering guide above 351 which is also connected to lifting/lowering line 352 which is taken up or slackened by winch 353. This apparatus section in either 3 or 4 times replication enables accurate horizontal positioning of each tendon/riser. The same function is performed by analogous structures 354, 355, 356, 357, 358 and 359 as shown in FIG. 15.

In accordance with one presently preferred mode of the invention, a tension leg platform (which has a floating structure floating on a body of water, tethers connected to the floor of the body of water at a locus beneath the floating structure, porches attached to the floating structure having tether receptacles for receiving upper terminations of the tethers, a reservoir above the water line for having a substantial amount of liquid ballast on the floating structure, and a sluice with a sluice gate for dumping liquid ballast from the reservoir for liquid ballast on the floating structure to take the floating structure to a heave-restrained mode) is taken to a heave-restrained mode by ballasting down the floating structure with liquid ballast, positioning the floating structure over a locus of attachment of the tethers on the floor of the body of water, positioning the upper terminations of the tethers in the tether receptacles of the porches, and then sluicing the liquid ballast from the floating structure via the sluice by rapidly opening the sluice gate such that tension is applied to the tethers in a relatively rapid and continuously increasing manner. This method of taking a tension leg platform to the heave-restrained mode is particularly applicable when the tension leg platform is a heave-restrained platform which comprises a floating structure having a central buoyancy means and at least three outrigger columns connected in substantially rigid relationship to one another, the central buoyancy means having supports for upper terminations of a plurality of production risers, the risers being connected to hydrocarbon wells on the floor of the body of water upon which the floating structure floats within a horizontal locus substantially beneath the floating structure and being connected to the floating structure under sufficient tension such as to function as tendons to restrain heave of the floating structure in the heave-restrained mode in addition to functioning as conduits for hydrocarbon production, each riser being comprised of plural concentric tubular structural and pressure containment elements connecting a hydrocarbon well on the floor of the body of water with a pressure containment means located on the floating structure, and at least three lateral anchor lines attached to the floating structure and attached to the floor of the body of water at loci lateral of the locus of attachment of the risers and under sufficient tension and in an array such as to maintain the floating structure substantially on horizontal location. In one still more presently preferred mode, the heave-restrained platform has a general configuration such as is shown in FIGS. 9, 10, 11, 12, and 13.

In accordance with the foregoing rapid deballasting or water dump method for taking the floating structure to a heave-restrained mode, it is preferred that the platform be ballasted down to a position substantially below its designated operating draft, that a set of installation risers/tendons be in position at the periphery of the moonpool and be supported by their motion-compensating tensioners, and that a desired percentage of the ballast be on board the platform and be located above the water line in symmetrically aranged tanks. These tanks are equipped with a number of very large valves or sluice gates on outlets or sluices to the sea or other body of water at the bottom of the tanks allowing for a very rapid release of the ballast water under gravitational force only. The valves can have an automatic activation mechanism/control facility that allows simultaneous operation.

In accordance with this mode, the installation risers/tendons can be supported on their tensioners so that the motion compensating stroke is moving a load collar/stress joint on the riser about a mean position just above but clear of the load-bearing surface of the permanent mooring receptacle.

The transition to the heave-restrained mode can proceed in accordance with the following example:

When the platform has started to move down from the peak of a predicted local near term maximum heave motion, all valves of the symmetrically arranged dump tanks are opened such that the downward motion is reversed by near instantaneous creation of excess buoyant force. If platform motions are suitably small prior to the ballast dumping or sluicing operation, then it is not necessary to time the release to occur as indicated above. The rapid change in ballast will cause the platform to rise upward so that the tensioners will stroke out allowing the riser collars to land in their loadbearing slots on the tension porches. The upward motion will continue until the potential energy realized by the ballast release is balanced by (1) the kinetic energy embodied in the heave motion of the platform at the start of the operation, (2) the kinetic energy losses to drag, diffraction, and friction and (3) the potential energy generated by stretching the riser/tendons. The platform will then oscillate in the heave-restrained mode about the new mean draft determined by balance of static buoyant, weight, and tension forces.

The amount of ballast to be dumped can readily be calculated by those skilled in the art for a particular circumstance, but should be calculated such that (1) the excess buoyancy will be sufficient to force the riser/tendons securely into their load receptacles and (2) induce enough tension in the set of installation/transition riser/tendons to ensure that the heave-restrained mode is maintained for any vertical motions anticipated while the platform is further deballasted through ordinary deballasting operations. Snap loads should be avoided. The platform should continue to be deballasted to bring the platform to targeted operating drafts as more riser/tendons are run to bring the platform to a permanent safely installed heave-restrained mode.

In accordance with yet another presently preferred mode, a method for achieving the heave-restrained mode of a platform (comprising a floating structure having a central buoyancy means and at least three outrigger columns connected in substantially rigid relationship to one another, the central buoyancy means having supports for upper terminations of a plurality of production risers, the risers being connected to hydrocarbon wells on the floor of a body of water upon which the floating structure floats within a horizontal locus generally beneath the floating structure and being connected to the floating structure under sufficient tension such as to function as tendons to restrain heave of the floating structure in addition to functioning as conduits for hydrocarbon production, each riser being comprised of plural concentric tubular structural and pressure containment elements connecting a hydrocarbon well on the floor of the body of water with a pressure containment means located on the floating structure, and at least three lateral anchor lines connected to the floating structure to the floor of the body of water at loci lateral of the locus of attachment of the risers and under sufficient tension and in an array such as to maintain the floating structure substantially on horizontal location) comprises the following sequence of steps:

ballasting the floating structure to above but near the heave-restrained level, running and connecting the risers to the floor of the body of water by conventional riser running technique or by the inventive method disclosed herein, lifting on the risers such as to further pull down the floating structure, positioning the upper termination of the risers into receptacles disposed on porches at a locus below the surface of the body of water and below the center of effective mass of the floating structure such that the risers come under tension, and deballasting the floating structure to take it to the heave-restrained mode and confer tendon attributes to the risers. This method is particularly presently preferred wherein the central buoyancy means comprises a central column having a moonpool which encloses the upper terminations of the risers and wherein the risers are lifted by means of a bridge crane and/or hydraulic rams.

More specifically, this method using a central lifting device capacity is particular applicable when a HRP/DS is equipped with a lifting device which can be located over the center of the moonpool as shown in the figures. The device will need to have a relatively large tension load carrying capacity and motion compensation. It can be located on a set of rotating beams and have the capacity for translation while supporting the weight and the tension of a riser. In this embodiment, it is in effect a rotating bridge crane and can be used to support a riser in the center and then be employed to move the riser/tendons into their support slots on the moonpool periphery in a suitable embodiment of the HRP/DS.

The central tensioning device can have enough tensioning capacity to change the draft of the platform by several feet by increasing or decreasing the amount of tension applied to a taut riser string that is affixed at its lower end to a secure point on the sea floor.

In one example, the transition process starts with the platform ballasted down to a position several feet below its designated operating draft. A set of installation riser/tendons are in position at the periphery of the moonpool and are supported by their motion compensating tensioners. The following sequence of steps should be completed in as short a time as possible. An additional riser string is run and connected to a preset point of fixation on the sea floor, for example a wellhead, and supported under tension on the central tensioning device. Deballasting of the platform is begun. The mean tension load on the central tensioning device is increased by stroking upward on a set of hydraulic tensioners while the platform is deballasting so that the platform maintains a constant draft. The installation riser tendons should be supported on their tensioners so that the motion compensating stroke is moving the connecting device or load collar/stress joint section of the riser about a mean position just above but clear of the load-bearing surface of the permanent mooring receptacle. When the tension load on the central tensioning device reaches the desired position through deballasting, the central tensioning device strokes downward to shed part of its tension load. As this tension is reduced, the platform will be pushed upward by the resulting excess buoyancy force. Simultaneously, the tensioners on the periphery will be forced to stroke out. The result is that the riser collars on the periphery can be brought to land in their load-bearing slots and begin to be stretched as the platform moves up to a new mean draft where the buoyant forces, weights, and tensions balance. Deballasting continues to bring the installation/tension risers/tendons to the desired level of mean tension. The riser string hanging on the central tensioning device can be retrieved to the surface or placed into an appropriate slot on the periphery. Additional riser/tendons are run and deballasting continues to bring the platform into a safety moored condition for survival of weather extremes. The method is particularly applicable for an HRP/DS having structural characteristics as shown in FIGS. 9, 10, 11, 12 and 13. Structures and devices shown in FIGS. 14 and 15 are also useful.

Other methods to take the HRP/DP to the heave-restrained mode, such as by hydraulic tensioner control methods known to the art for taking a TLP to the heave-restrained mode can also be employed.

Further referring to FIGS. 14 and 15, the following relates further to the centering guide device for the HRP/DS shown therein. The device allows control of the horizontal position of the riser strings for various reasons as follow:

during running operations, the part of the string extending below the moonpool will experience drag force from any sea current present during the operation. It is advantageous to be able to hold the string away from the previously installed risers on the side of the moonpool to which the current is trying to push the string as it is being run.

The guiding device can be used to obtain fine tuning on positioning of the bottom of a riser string as it approaches the floor of the body of water. Generally, the platform spread mooring system will be employed to move the platform over a desired position, but its tension adjustment equipment and operations can be beneficially complemented by the more precise control possible with the centering guide apparatus.

When a riser string is attached between the central (top end) tensioning device in the sea floor, it is important to ensure that relative motion between the platform and the riser string does not bring the riser string into damaging contact with structures and risers on the periphery of the moonpool. The centering guide apparatus will ensure that such contact does not occur even if or when the platform might be temporarily abandoned due to extreme storm conditions.

The centering guide comprises a hollowed structure element formed of opposing halves or thirds that can be rigidly connected together around the riser string, tensioning winches, wires, guides, power supply, and control system, the key elements of which are shown in two embodiments in FIGS. 14 and 15.

In accordance with another presently preferred mode of the invention, riser tendons are installed for maintaining a floating structure in a heave-restrained mode by a method which comprises the following steps:

A first surface conductor is run and disposed in the floor of a body of water on which the floating structure floats. A borehole of smaller diameter than the first conductor is drilled through the first conductor to a depth sufficient for control of drilling fluid pressure. A second conductor is emplaced and cemented inside the first conductor and the borehole. A second borehole of smaller diameter than the second conductor is drilled through the second conductor to a depth sufficient to contain any subterranean formation pressure. A casing string is emplaced and cemented inside the second conductor for a formation pressure containment distance but not above the floor of a the body of water and inside the second borehole to provide a multiple walled system for redundant well control. Thereupon, a surface blowout preventer system (BOPS) is installed on the floating structure and the multiple walled system. Thereupon one or more successive boreholes are drilled through the casing string or successive casing strings until a successive borehole has penetrated a hydrocarbon bearing formation. Then one or more successive casing strings are emplaced and cemented inside the successive boreholes and inside the next successive casing strings for a pressure containment distance but not above the floor of the body of water. Thereupon, while the hydrocarbon bearing formation is isolated by a cemented successive casing, one or more casings and conductors are disconnected and retrieved from above the floor of the body of water in sequence from smaller to larger. Thereupon, one or more conductors and at least one riser are run and connected or left in place such that at least two tubulars connect in fluid tight and pressure competent double wall isolation the innermost casing at the floor of the body of water to a pressure containment means on the floating structure.

Multiple walled riser systems disposed in accordance with this method provide redundant well control. Use of smaller diameter outer risers is also possible. This degree of safety cannot be achieved with a single walled riser system unless complex and expensive additional equipment is used. By way of more specific example, the initial conductor can be run on a drillstring and jetted or drilled in with a mud motor that is placed inside the conductor. The conductor can be positioned by moving the floating vessel with the spread mooring system if the vessel is an HRP/DS, by means of tugs, by thrusters, or by other means known to the art. An ROV can be used to direct spread mooring adjustment in the case of the an HRP/DS. This emplacement of the initial conductor is a procedure well known by those skilled in the art and is commonly used to install conductors from a semisubmersible. Typically, 30 or 36" diameter conductors are initially installed to 300 to 500 ft. below the sea floor for normal drilling operations. If desirable, a larger diameter conductor can be installed to provide greater lateral support for mooring in the case of an HRP/DS in severe environments.

After the first conductor is jetted or mud motor drilled in, the drilling bottom hole assembly can be mechanically disconnected from the top of the conductor prior to drilling the hole for the next conductor. Typically, a 26" hole is drilled through the 30" conductor to 1,000 to 1,500 ft. beneath a sea floor and a 20" conductor is installed in the drilled hole. A larger conductor could be installed if the first conductor is larger. If desired, the second conductor may be installed deeper if circumstances make this advisable.

The second conductor can be emplaced and cemented by either of two exemplary methods. In accordance with the first method, the second conductor is run on a drillstring, cemented by pumping cement through the drillstring and conductor so that the cement fills the annulus between the first conductor and the second conductor. The drillstring can be remotely disconnected from a wellhead housing which is disposed at the top of the conductor and retrieved to the floating structure.

In accordance with the other exemplary method, a sufficient amount of the second conductor is run so as to extend from the floating structure to the bottom of the borehole. Cement is pumped down the conductor string to fill the annulus between the conductors below the sea floor. In accordance with one mode, a connector may be run in the second conductor to facilitate removal of the riser sections from the sea floor to the floating structure. This may be advantageous to minimize wave loads and minimize the weight of riser that must be supported by the floating structure. This can be accomplished by use of left-handed threads and right-handed threads and activation by rotation of the conductor string or by rotation of a drillstring inside the conductor. Such techniques in the abstract are well known to those skilled in the art. Further exemplification on mud line suspension systems useful in the practice of the invention are marketed by Dril-Quip Inc., 13550 Hempsted Rd., Houston, Tex. 77040. A copy of a portion of a brochure put out by that company relating to the "Drill-Quip MS15 mud line suspension system" is provided with this application and is herewith incorporated by reference as one example of a suitable system for practicing this method of this invention.

A borehole can be next drilled beneath the second conductor for the first casing string. Typically, a 17½" borehole is drilled for emplacement of 13⅜" casing. The casing string should in any event be installed prior to drilling into any suspected abnormally pressured formations, particularly those that cannot be controlled by a column of seawater when the method is practiced at greater water depths. Thus, at least two concentric strings of conductor and/or casing will in such event be in place when abnormal pressures are encountered if such is the case.

After the casing string has been installed, a multiple walled system is then emplaced to provide redundant well control necessary for safe operations.

Surface BOPS are installed atop the double walled riser system to provide well control for additional drilling in accordance with one presently preferred mode. For example, a 12¼" borehole would be drilled beneath the 13⅜" casing and 9⅝" casing would be cemented in the 12¼" borehole.

In deep water, there is a particular need to reduce riser and tendon weights which must be supported by the floating structure. Any weight saving at this point has huge multiplier effect on the necessary size and expense of the floating structure. The same multiplier effect occurs in other branches of engineering, particularly in the design of aircraft. If circumstances determine that this is advisable, the following procedure can be followed.

Immediately after a casing string is installed and while no open hole is exposed and the wellbore is safely contained by continuous cemented casing, the smallest internal casing riser is disconnected near the sea floor and retrieved to the vessel. For example, the 9⅝" casing would be disconnected by rotation from the surface so as to unscrew a left-handed connection near the sea floor. A separate set of threads in the connector would accept a right-hand rotation makeup for later reconnection in this mode.

Successive risers are disconnected to remove all risers if this is appropriate.

The desired outer riser is then rerun and reconnected. Successive smaller risers are finally rerun and reconnected to provide the required multiple walled riser for well control and the necessary cross-section area for strength in vertical mooring of the floating structure, as in the case of a HRP/DS or TLP.

In the case of a heave-restrained floating structure, the conductors must be designed to provide sufficient lateral load resistance and actual tension load resistance to moor the floating structure in a heave-restrained mode. The cross-sectional area of conductor-tether-risers and the tension in these elements must be selected to properly restrain vessel heave and maintain an acceptably short resonance period for the vessel. Many variations and modifications may be made to the apparatus and techniques described above by those having experience in this technology without departing from the concept of the invention. Accordingly, the apparatus and methods depicted in the drawings and referred to in the foregoing description are for purposes of illustration only and are not intended as limitations on the scope of the invention.

We claim:

1. A heave-restrained platform comprising:

(a) a floating structure having a central buoyancy means and at least three outrigger columns connected in substantially rigid relationship to one another, the central buoyancy means having supports for upper terminations of a plurality of production risers, (b) means for imparting sole vertical tension comprising a plurality of production risers connected to hydrocarbon wells on the floor of a body of water upon which the floating structure floats within a horizontal locus on the floor of the body of water generally beneath the floating structure and being connected to the floating structure under sufficient tension so as to function as sole vertical tendons to substantially completely restrain heave of the floating structure in addition to functioning as conduits for hydrocarbon production, (c) each riser being comprised on plural concentric tubular structural and pressure containment elements connecting a hydrocarbon well on the floor of the body of water with a pressure containment means located on the floating structure, and (d) at least three lateral anchor lines attached to the floating structure and to the floor of the body of water at loci lateral of the horizontal locus on the floor of the body of water of attachment of the risers and under sufficient tension and in an array so as to maintain the floating structure substantially on horizontal location.

2. The heave-restrained platform of claim 1 wherein the lateral anchor lines are selected from the group consisting of catenary anchor lines and spring buoy anchor lines; and wherein the risers are connected to the floating structure via porches at a locus below the surface of the body of water and below the center of effective mass of the floating structure.

3. The heave-restrained platform of claim 1 wherein the lateral anchor lines are spring buoy anchor lines.

4. The heave-restrained platform of claim 1 wherein the risers are comprised of concentric tubulars.

5. The heave-restrained platform of claim 1 wherein the floating structure has a generally horizontally centrally located drilling derrick.

6. The heave-restrained platform of claim 5 wherein the risers have added buoyancy means attached thereto or integral therewith.

7. The heave-restrained platform of claim 1 wherein the central buoyancy means comprises a central column having a moonpool which encloses the upper terminations of the risers.

8. The heave-restrained platform of claim 1 wherein the central buoyancy means comprises a central column which has the supports for the upper terminations of the risers affixed in symmetrical array about its circumference.

9. The heave-restrained platform of claim 1 wherein the central buoyancy means comprises a plurality of columns arrayed about the horizontal center of the floating structure and a buoyant ring structure comprising part of a base mat pontoon and having the supports of the upper terminations of the risers affixed in symmetrical array within a central opening of the base mat pontoon about the horizontal center of the floating structure.

10. The heave-restrained platform of claim 7 wherein the buoyancy distribution is such as to minimize tension variations of the risers and minimize at least one of pitch and roll.

11. The heave-restrained platform of claim 7 wherein the risers are connected to the floating structure via porches at a locus below the surface of the body of water and below the center of effective mass of the floating structure.

12. The heave-restrained platform of claim 7 wherein a heavy duty lifting crane is disposed overhead of the pressure containment means and is movable over the moonpool.

13. A method for taking a heave-restrained platform (comprising:

(a) a floating structure having a central buoyancy means and at least three outrigger columns connected in substantially rigid relationship to one another, the central buoyancy means having supports for upper terminations of a plurality of production risers, (b) a plurality of production risers connected to hydrocarbon wells on the floor of a body of a water upon which the floating structure floats within a horizontal locus on the floor of the body of water generally beneath the floating structure and being connected to the floating structure under sufficient tension so as to function as sole vertical tendons to substantially completely restrain heave of the floating structure in addition to functioning as conduits for hydrocarbon production, (c) each riser being comprised of plural concentric tubular structural and pressure containment elements connecting a hydrocarbon well on the floor of the body of water with a pressure containment means located on the floating structure, and (d) at least three lateral anchor lines attached to the floating structure and to the floor of the body of water at loci lateral of the horizontal locus on the floor of the body of water of attachment of the risers and under sufficient tension and in an array so as to maintain the floating structure substantially on horizontal location) to the heave-restrained mode comprising:

(e) ballasting the floating structure to above but near the heave-restrained level, (f) running and connecting the risers to the floor of the body of water, (g) lifting on the risers such as to further pull down the floating structure and positioning the upper terminations of the risers into receptacles disposed on porches at a locus below the surface of the body of water and below the center of effective mass of the floating structure so that the risers come under tension, and (h) deballasting the floating structure to take it to the heave-restrained mode and confer tendon attributes to the risers.

14. The method of claim 13 wherein the central buoyancy means comprises a central column having a moonpool which encloses the upper terminations of the risers and wherein the risers are lifted by a means selected from the group consisting of (a) a bridge crane and (b) hydraulic rams.

15. The method of claim 13 wherein the risers are run by:

(a) running a first surface conductor and disposing the first surface conductor in the floor of a body of water on which the floating structure floats, (b) drilling a borehole of smaller diameter than the first surface conductor through the first surface conductor to a depth sufficient for control of drilling fluid pressure, (c) emplacing and cementing a second conductor inside the first surface conductor and the borehole, (d) drilling a second borehole of smaller diameter than the second conductor through the second cnductor to a depth sufficient for control of subterranean formation pressure, (e) emplacing and cementing a casing string inside the second conductor for a pressure containment distance but not above the floor of the body of water and inside the second borehole to provide a multiple walled system for redundant well control, (f) thereupon installing a surface blowout preventer system (BOPS) on the floating structure and the multiple walled system, (g) drilling at least one successive borehole through the casing string or successive casing strings until a successive borehole has penetrated a hydrocarbon bearing formation and emplacing and cementing at least one successive casing string inside the successive borehole and inside the next successive casing string for a pressure containment distance but not above the floor of the body of water, (h) thereupon, while the hydrocarbon-bearing formation is isolated by a cemented successive casing string, disconnecting and retrieving from above the floor of the body of water in sequence from smaller to larger at least one of such casing strings, (i) thereupon, disposing in place (running and connecting or leaving in place) at least one tubular (a conductor and/or a riser) so that at least two tubulars connect in fluid tight double wall isolation the innermost casing at the floor of the body of water to the floating structure, and (j) imparting tension on at least one of the at least two tubulars from the floating structure such as to suppress heave of the floating structure.

16. The method of claim 15 wherein all heave of the floating structure is suppressed by at least one riser tendon.

17. The method of claim 16 wherein the lateral anchor lines are selected from the group consisting of neutrally buoyant elastic lines, catenary anchor lines, and spring buoy anchor lines; and wherein the riser/tendons are connected to the floating structure via porches at a locus below the surface of the body of water and below the center of effective mass of the floating structure.

18. The method of claim 17 wherein the riser/tendons have added buoyancy means (attached thereto or integral therewith).

19. The method of claim 13 wherein the central buoyancy means comprises a central column having a moonpool which encloses the upper terminations of the risers.

20. The method of claim 13 wherein the central buoyancy means of the heave-restrained platform comprises a plurality of columns arrayed about the horizontal center of the floating structure and a buoyant ring structure comprising part of a base mat pontoon and having the supports for the upper terminations of the riser/tendons affixed in symmetrical array within a central opening of the base mat pontoon about the horizontal center of the floating structure.

21. The method of claim 15 wherein in step (c) the second conductor is emplaced and cemented inside the first conductor and the borehole by running the second conductor on a drillstring, cementing by pumping cement through the drillstring and conductors so that the cement fills the annulus between the first conductor and the second conductor, and remotely disconnecting the drillstring from a wellhead housing disposed atop the conductors and retrieved to the floating structure.

* * * * *